US011598530B2

(12) United States Patent
Cadima et al.

(10) Patent No.: US 11,598,530 B2
(45) Date of Patent: Mar. 7, 2023

(54) COOKTOP APPLIANCE AND HEATING ELEMENT HAVING A THERMOSTAT

(71) Applicant: Haier US Appliance Solutions, Inc., Wilmington, DE (US)

(72) Inventors: Paul Bryan Cadima, Crestwood, KY (US); Mark Heimerdinger, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 243 days.

(21) Appl. No.: 16/926,014

(22) Filed: Jul. 10, 2020

(65) Prior Publication Data

US 2022/0010967 A1 Jan. 13, 2022

(51) Int. Cl.

| | |
|---|---|
| ***F24C 7/08*** | (2006.01) |
| ***H05B 1/02*** | (2006.01) |
| ***H05B 3/76*** | (2006.01) |

(52) U.S. Cl.
CPC ..... *F24C 7/087* (2013.01); *H05B 1/0213* (2013.01); *H05B 1/0266* (2013.01); *H05B 3/76* (2013.01)

(58) Field of Classification Search
CPC ..... F24C 7/067; F24C 7/083; F24C 7/087; H05B 1/0266; H05B 1/0213
See application file for complete search history.

(56) References Cited

U.S. PATENT DOCUMENTS

| | | | | |
|---|---|---|---|---|
| 2,997,561 | A | 8/1961 | Siri | |
| 4,039,991 | A * | 8/1977 | Bucheister | H01H 37/5409 337/348 |
| 4,812,624 | A | 3/1989 | Kern | |
| 5,043,690 | A * | 8/1991 | Wahls | H01H 37/54 337/342 |
| 6,246,033 | B1 * | 6/2001 | Shah | H05B 3/68 219/447.1 |
| 6,753,509 | B2 | 6/2004 | Gratz et al. | |
| 7,218,200 | B2 | 5/2007 | Hayashi | |
| 8,723,085 | B2 * | 5/2014 | Callahan | F24C 7/087 219/448.11 |
| 2008/0264926 | A1 | 10/2008 | Peng | |
| 2018/0238559 | A1 | 8/2018 | Pasqual et al. | |

FOREIGN PATENT DOCUMENTS

| | | | |
|---|---|---|---|
| CN | 1133435 | A | 10/1996 |
| CN | 206252382 | U | 6/2017 |
| EP | 0982973 | A2 | 3/2000 |
| GB | 2414559 | B | 8/2007 |
| KR | 200448412 | Y1 | 4/2010 |

* cited by examiner

*Primary Examiner* — Thien S Tran
(74) *Attorney, Agent, or Firm* — Dority & Manning, P.A.

(57) ABSTRACT

A cooktop appliance and heating element, as provided herein may define a heating zone having a thermostat positioned therein. The thermostat may include a base, a bimetallic disk, and a conductive spring. The base may extend axially between a first end and a second end. The bimetallic disk may be disposed within the base. The conductive spring may be disposed within the base in biased engagement with the bimetallic disk to motivate the bimetallic disk towards the first end within the base. The conductive spring may include a first layer and a second layer. The first layer may extend from a contact end proximal to the bimetallic disk to a joinder end connected to the first terminal. The second layer may extend from a biasing end proximal to the bimetallic disk to a secured end fixed within the base.

20 Claims, 8 Drawing Sheets

COOKTOP APPLIANCE AND HEATING ELEMENT HAVING A THERMOSTAT

FIELD OF THE INVENTION

The present subject matter relates generally to electric heating elements for appliances, such as for cooktop or range appliances.

BACKGROUND OF THE INVENTION

Cooking appliances that include a cooktop traditionally have at least one heating element (e.g., electric coil heating element) positioned on a panel proximate a cooktop surface for use in heating or cooking an object, such as a cooking utensil, and its contents. Recent regulatory requirements mandate that electric coil heating elements on cooktop appliances be incapable of heating cooking oil to an oil ignition temperature. Thus, certain electric coil heating elements utilize a bimetallic thermostat to interrupt power to the coil when the thermostat reaches a tripping point. In some cooktops, the thermostat is remotely positioned from the cookware and infers the cookware temperature through correlation. In other cooktops, the thermostat contacts a bottom of the cookware to improve correlation.

Whether remotely positioned from the cookware or contacting the cookware, bimetallic thermostats generally rely on an internal spring or resistance force to maintain positive pressure on the internal electrical contacts. For instance, an internal spring may act against an enclosed bimetallic element. Thermal expansion of the bimetallic element at a known temperature allows the bimetallic thermostat to act against the spring to open or close the electrical circuit through the thermostat.

Known coil heating elements using bimetallic thermostats have shortcomings, however. In particular, over time, the internal spring may anneal. This will, in turn, often degrade performance of the thermostat. For instance, the tripping point of the thermostat may shift or change as the internal spring anneals. Although using heat-resistant metals to prevent annealing have been used in other high-temperature fields, these are often not suitable for a bimetallic thermostat since, for instance, the high electrical resistivity of most heat-resistant metals generates even more heat when conducting an electrical current. This heat generation may, in turn, cause the thermostat to detect a higher temperature or trip too early.

As a result, it would be useful to have a cooktop appliance addressing one or more of the above identified issues. In particular, it may be advantageous to provide a cooktop appliance having a thermostat with one or more features for reliably and accurately detecting heat at a consistent tripping point over time. Additionally or alternatively, it may be advantageous to have a thermostat with one or more features for maintaining consistent spring force without generating excessive heat within the thermostat.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an electric resistance heating coil assembly is provided. The electric resistance heating coil assembly may include a spiral wound sheathed heating element and a thermostat. The spiral wound sheathed heating element may have a first coil section and a second coil section. The thermostat may be connected in series between the first and second coil sections of the spiral wound sheathed heating element. The thermostat may include a base, a first terminal, a bimetallic disk, and a conductive spring. The base may extend axially between a first end and a second end. The first terminal may be mounted to the base and connected to the first coil section. The bimetallic disk may be disposed within the base. The conductive spring may be disposed within the base in biased engagement with the bimetallic disk to motivate the bimetallic disk towards the first end within the base. The conductive spring may include a first layer and a second layer. The first layer may extend from a contact end proximal to the bimetallic disk to a joinder end connected to the first terminal. The second layer may extend from a biasing end proximal to the bimetallic disk to a secured end fixed within the base.

In another exemplary aspect of the present disclosure, a cooktop appliance is provided. The cooktop appliance may include a heating element and a thermostat. The heating element may define a heating zone. The thermostat may be positioned within the heating zone of the heating element. The thermostat may include a base, a bimetallic disk, and a conductive spring. The base may extend axially between a first end and a second end. The bimetallic disk may be disposed within the base. The conductive spring may be disposed within the base in biased engagement with the bimetallic disk to motivate the bimetallic disk towards the first end within the base. The conductive spring may include a first layer and a second layer. The first layer may extend from a contact end proximal to the bimetallic disk to a joinder end connected to the first terminal. The second layer may extend from a biasing end proximal to the bimetallic disk to a secured end fixed within the base.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
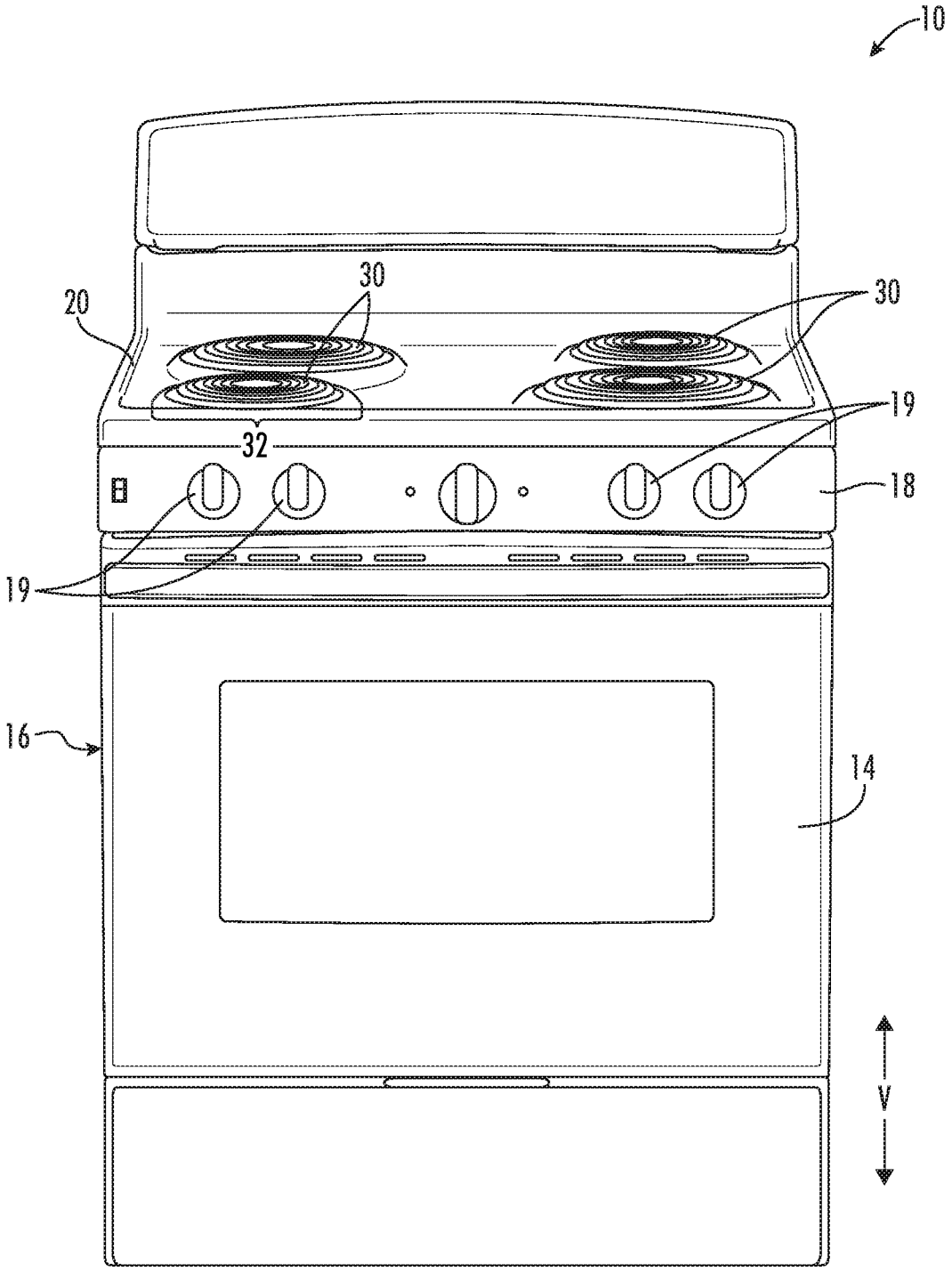
FIG. 1 provides a front, perspective view of a range appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

Turning now to the figures, FIG. 1 provides a front, perspective view of a range appliance 10 according to exemplary embodiments of the present disclosure. Range appliance 10 is provided by way of example only and is not intended to limit the present subject matter to the particular arrangement shown in FIG. 1. Thus, the present subject matter may be used with other cooktop appliance configurations (e.g., double oven range appliances, standalone cooktop appliances, etc.).

Generally, a top panel 20 of range appliance 10 includes one or more heating elements 30. Heating elements 30 may be, for example, electrical resistive heating elements. Range appliance 10 may include only one type of heating element 30, or range appliance 10 may include a combination of different types of heating elements 30, such as a combination of electrical resistive heating elements and gas burners. Further, heating elements 30 may have any suitable shape and size, and a combination of heating elements 30 of different shapes and sizes may be used.

Generally, each heating element 30 defines a heating zone 32 on which a cooking utensil, such as a pot, pan, or the like, may be placed to cook or heat food items placed in the cooking utensil. In some embodiments, range appliance 10 also includes a door 14 that permits access to a cooking chamber 16 of range appliance 10 (e.g., for cooking or baking of food items therein). A control panel 18 having controls 19 permits a user to make selections for cooking of food items—although shown on a front panel of range appliance 10, control panel 18 may be positioned in any suitable location. Controls 19 may include buttons, knobs, and the like, as well as combinations thereof. As an example, a user may manipulate one or more controls 19 to select a temperature or a heat or power output for each heating element 30.

Figure 2:
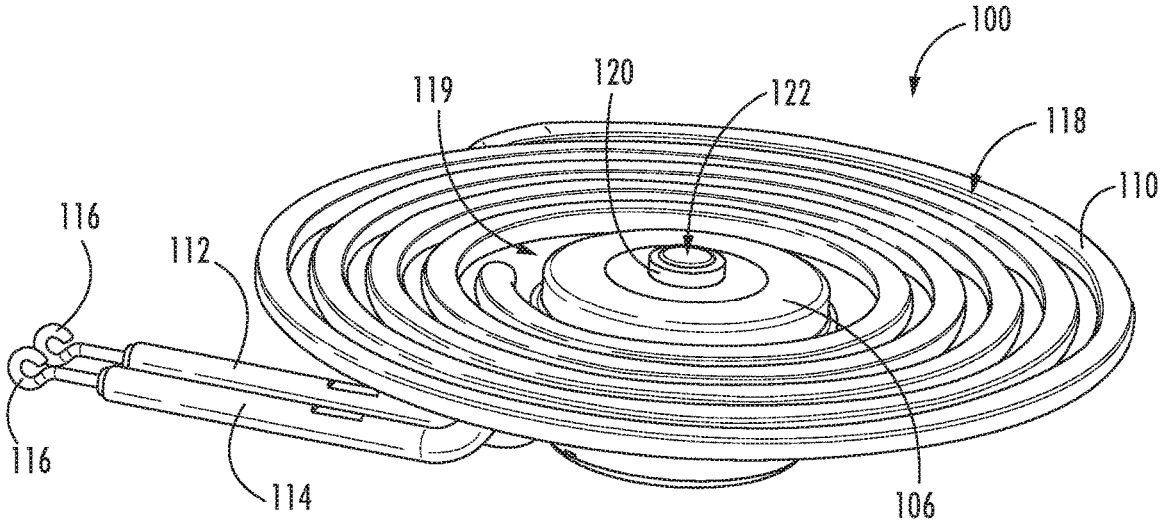
FIG. 2 provides a top, perspective view of an electric resistance heating coil assembly of the exemplary range appliance of FIG. 1.
Figure 3:
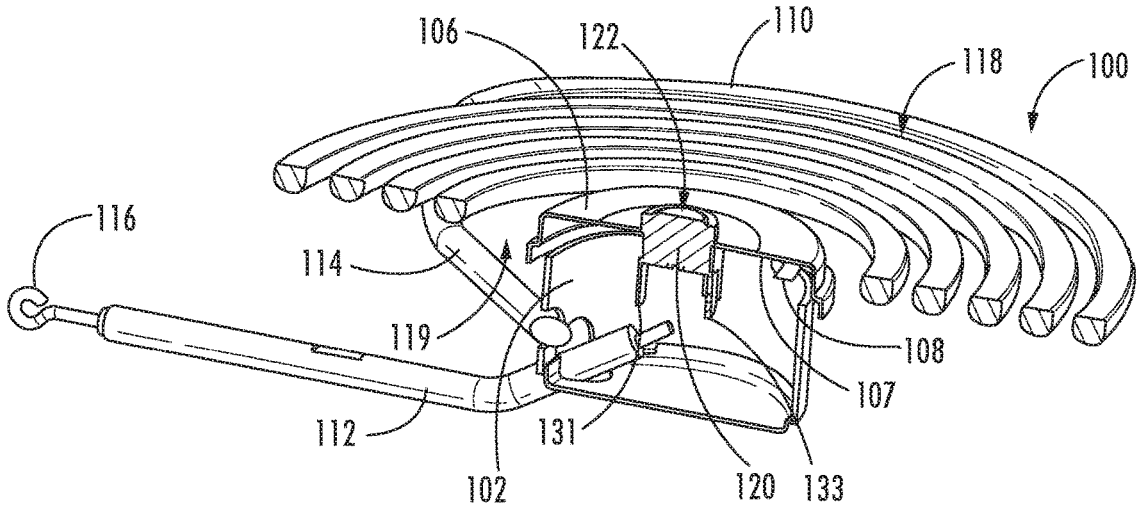
FIG. 3 provides a sectional view of the exemplary electric resistance heating coil assembly of FIG. 2.
Figure 4:
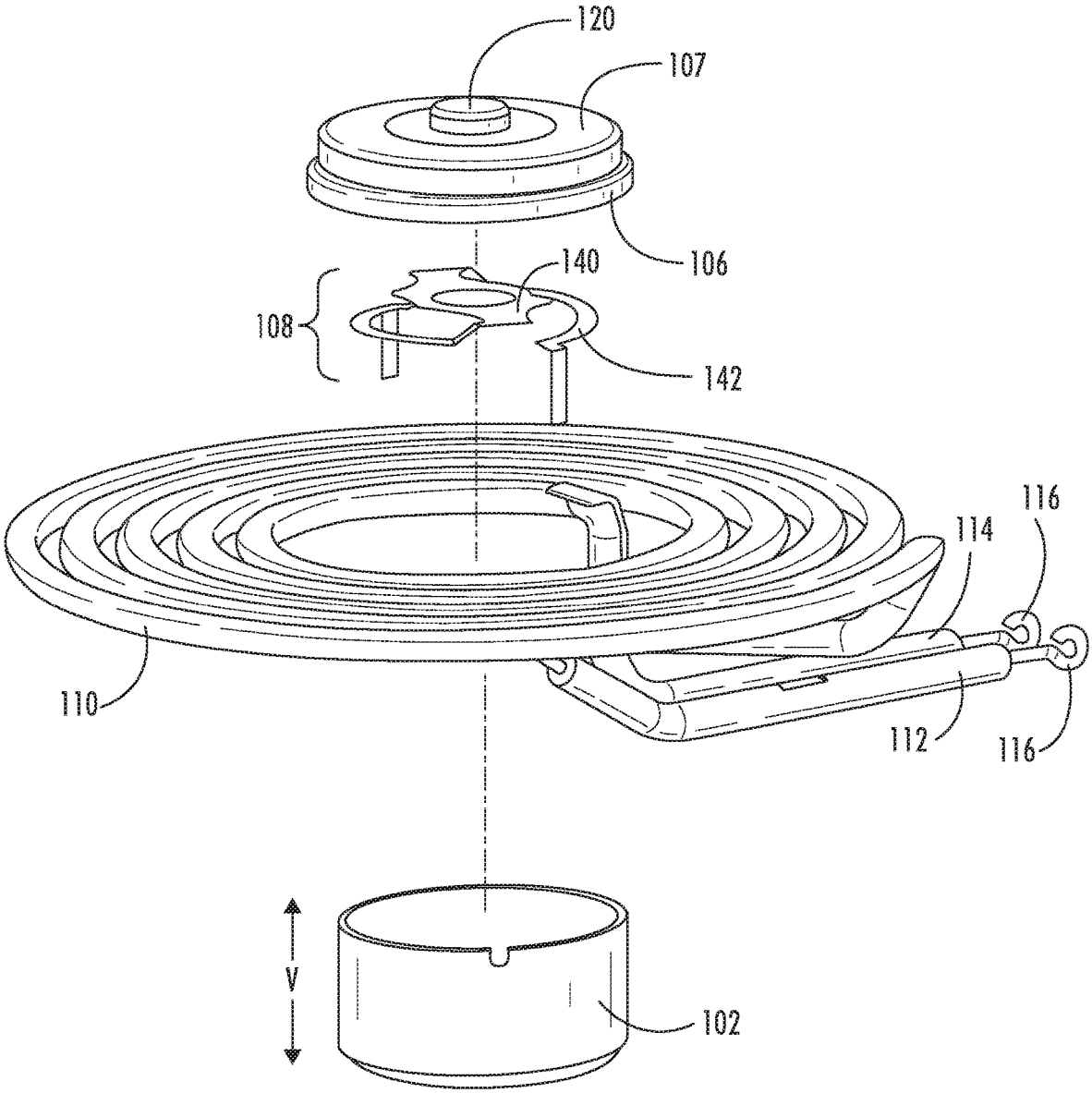
FIG. 4 provides an exploded perspective view of a portion of the exemplary heating coil assembly of FIG. 2.

Turning now to FIGS. 2 through 4, FIG. 2 provides a top, perspective view of an electric resistance heating coil assembly 100 of range appliance 10. FIG. 3 provides a sectional view of electric resistance heating coil assembly 100. FIG. 4 provides an exploded perspective view of a portion of electric resistance heating coil assembly 100. Electric resistance heating coil assembly 100 may be used as one or more of heating elements 30 in range appliance 10. However, while described in greater detail below in the context of range appliance 10, it will be understood that electric resistance heating coil assembly 100 may be used in or with any suitable cooktop appliance in alternative example embodiments. As discussed in greater detail below, electric resistance heating coil assembly 100 includes features for facilitating conductive heat transfer between a thermostat (e.g., bimetallic thermostat 120) and a utensil positioned on electric resistance heating coil assembly 100.

As shown, some embodiments of electric resistance heating coil assembly 100 include a spiral wound sheathed heating element 110. Spiral wound sheathed heating element 110 may include a first coil section 112 and a second coil section 114. In certain embodiments, spiral wound sheathed heating element 110 also has a pair of terminals 116. Each of first and second coil sections 112, 114 may be directly coupled or connected to a respective terminal 116. A voltage differential across terminals 116 induces an electrical current through spiral wound sheathed heating element 110, and spiral wound sheathed heating element 110 may increase in temperature by resisting the electrical current through spiral wound sheathed heating element 110.

Within the heating zone 32, a sensor support assembly, including thermostat 120, is positioned. When assembled, bimetallic thermostat 120 is connected, for example, in series between first and second coil sections 112, 114 of spiral wound sheathed heating element 110 (e.g., at a pair of discrete thermostat terminals 130, 132, as would be understood). Bimetallic thermostat 120 opens and closes in response to a temperature of bimetallic thermostat 120. For example, bimetallic thermostat 120 may be spring loaded such that a distal end 122 of bimetallic thermostat 120 is urged away from a top surface 118 of spiral wound sheathed heating element 110. Thus, distal end 122 of bimetallic thermostat 120 may be urged towards or against a utensil (not shown) positioned on top surface 118 of spiral wound sheathed heating element 110. Bimetallic thermostat 120 may respond to the temperature of the utensil on top surface 118 of spiral wound sheathed heating element 110 due to heat transfer between the utensil and bimetallic thermostat 120.

In some embodiments, bimetallic thermostat 120 is positioned concentrically with a center 119 of spiral wound sheathed heating element 110. For instance, center 119 of spiral wound sheathed heating element 110 may be open, and spiral wound sheathed heating element 110 may extend circumferentially around bimetallic thermostat 120 at center 119.

The sensor support assembly may also include a shroud 102 and coil support arms (not pictured). As would be understood, the coil support arms may extend (e.g., radially) from shroud 102, and spiral wound sheathed heating element 110 is positioned on and supported by the coil support arms. When assembled, the coil support arms may rest on top panel 20 to support electric resistance heating coil assembly 100 on top panel 20. Bimetallic thermostat 120 may be mounted to a shroud cover 106 below top cap 126. For instance, a support flange 128 of thermostat 120, which may extend radially from base 124 or top cap 126, may be joined to shroud cover 106 (e.g., on a top wall 107 of shroud cover 106). In some embodiments, support flange 128 is joined to shroud cover 106 (e.g., via welding or a suitable mechanical fastener, such as a screw or rivet).

When assembled, support flange 128 may be positioned below at least a portion of heating element 110 (e.g., below top surface 118). Moreover, shroud cover 106 is positioned below top cap 126. Additionally or alternatively, shroud cover 106 may extend over shroud 102. In particular, a top of shroud 102 may be held radially inward from an outer edge of shroud cover 106. When assembled, shroud 102, including shroud cover 106, generally shields bimetallic thermostat 120 from at least a portion of the heat generated at spiral wound sheathed heating element 110. Optionally, shroud 102, including shroud cover 106, is formed from a relatively low thermal conductivity metal (e.g., steel or a steel alloy).

In some embodiments, a spring bracket 108 biases shroud cover 106 and bimetallic thermostat 120 thereon upwardly. As shown, spring bracket 108 may include a mounting plate 140 and one or more biasing arms 142 extending therefrom. When assembled, bimetallic thermostat 120 is mounted or fixed to mounting plate 140. For instance, bimetallic thermostat 120 can be welded, clipped, or otherwise attached to mounting plate 140 with mechanical fasteners (e.g., screws or rivets), or a combination thereof. Biasing arms 142 may be resilient members, which generally urge mounting plate 140 upward. Spring bracket 108, including biasing arms 142, may be formed from any suitable high yield strength material. For instance, spring bracket 108 is formed of a stainless steel, full hard, or spring tempered material. Spring bracket 108 can be formed of other suitable high yield strength materials as well.

Figure 5:
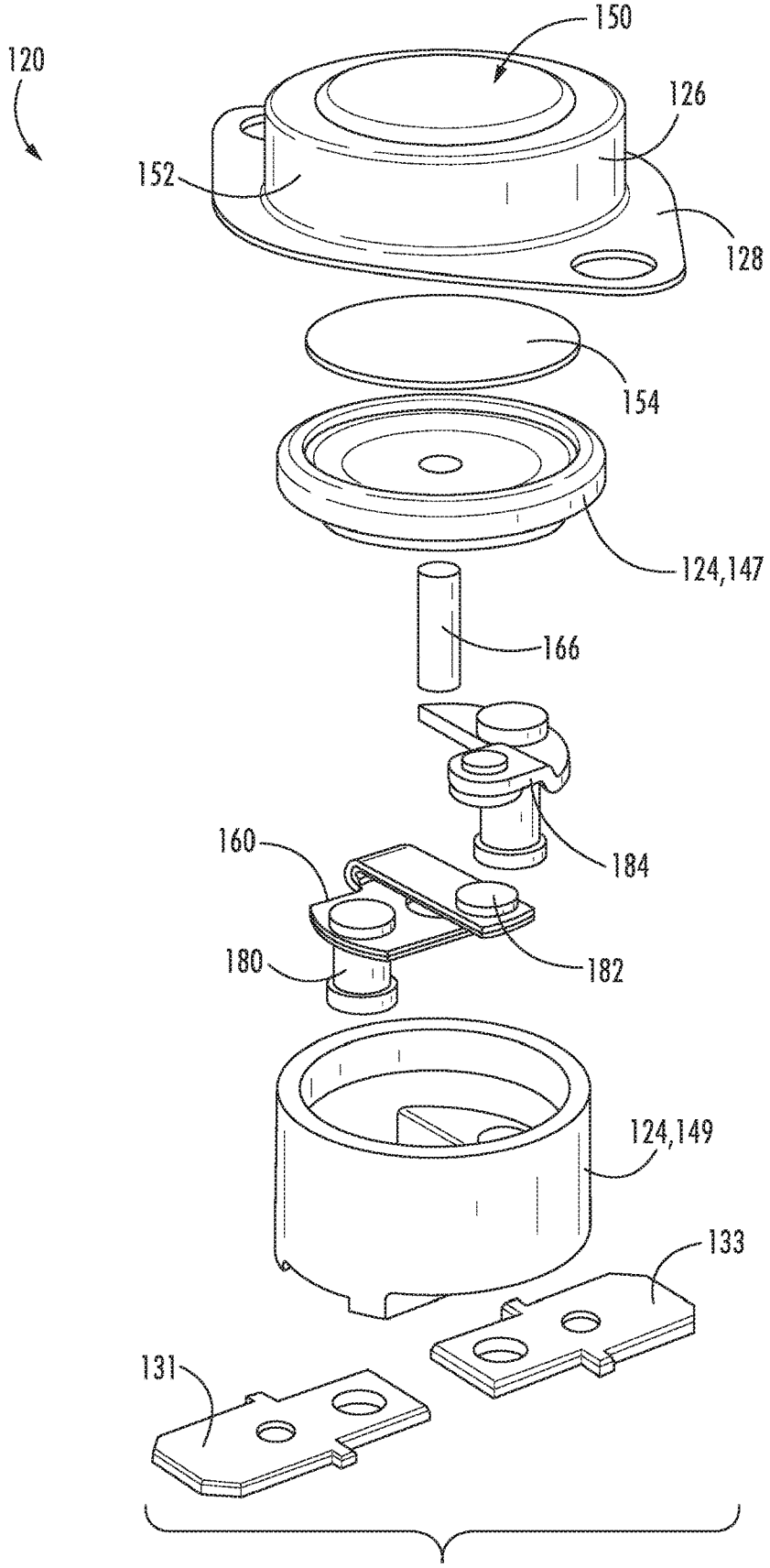
FIG. 5 provides an exploded perspective view of a thermostat of the exemplary heating coil assembly of FIG. 2.
Figure 6:
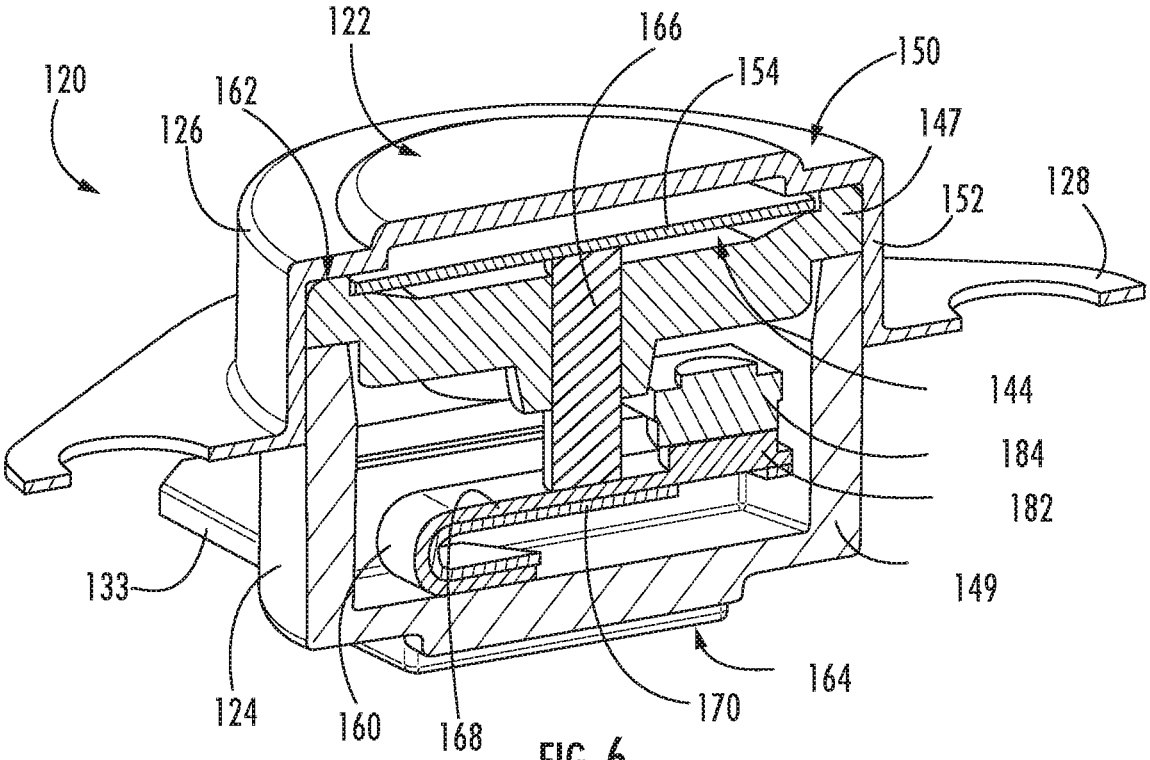
FIG. 6 provides a sectional perspective view of a thermostat of the exemplary heating coil assembly of FIG. 2.
Figure 7:
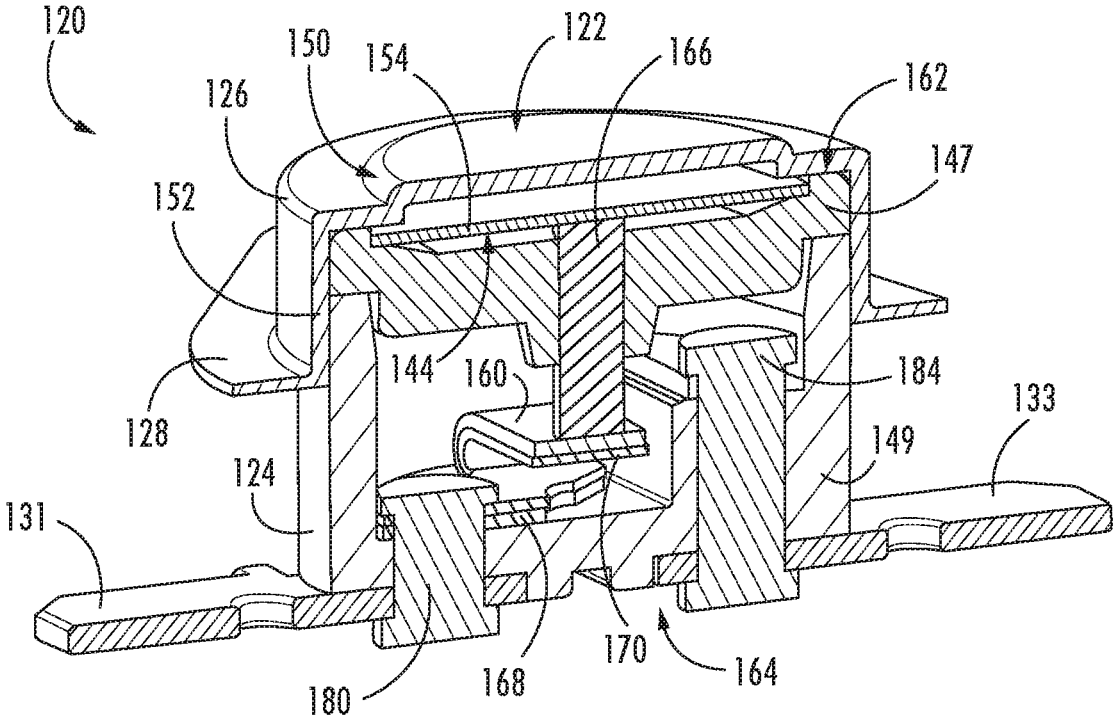
FIG. 7 provides another sectional perspective view of a thermostat of the exemplary heating coil assembly of FIG. 2.
Figure 8:
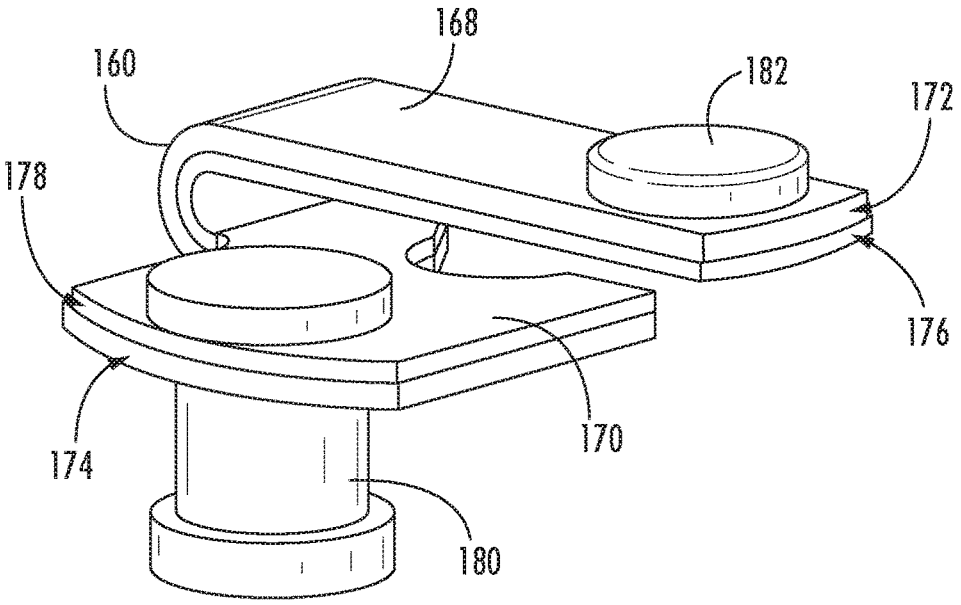
FIG. 8 provides a perspective view of a conductive spring of a thermostat according to exemplary embodiments of the present disclosure.
Figure 9:
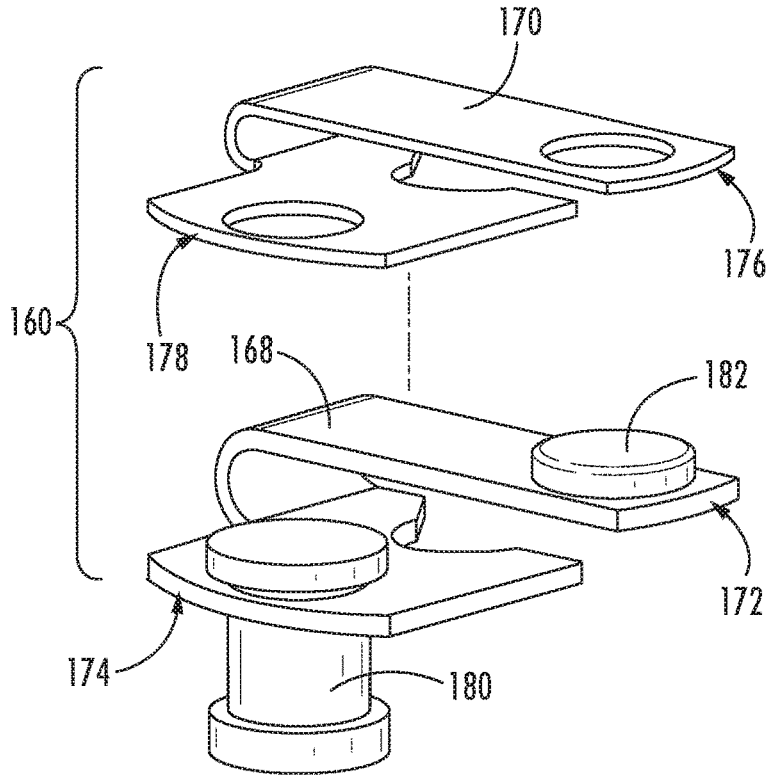
FIG. 9 provides an exploded perspective view of the exemplary conductive spring of FIG. 8.
Figure 10:
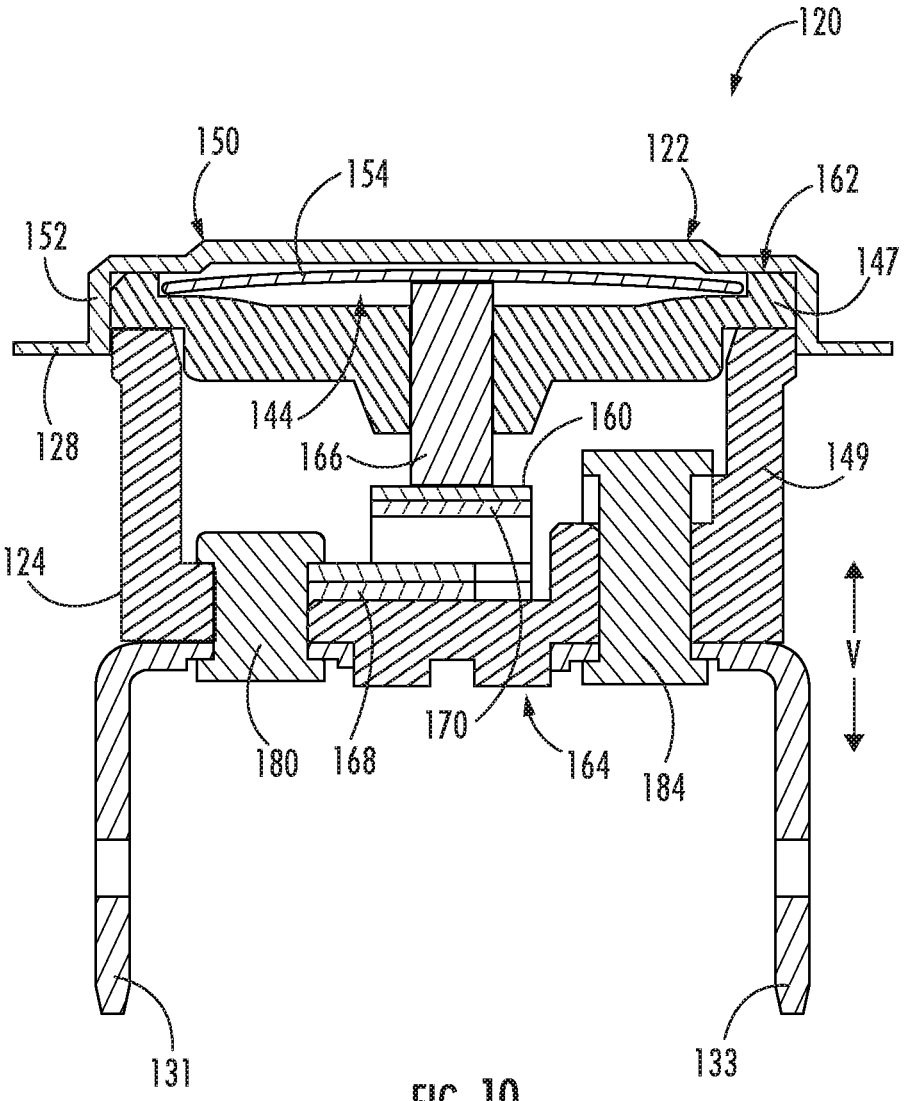
FIG. 10 provides a sectional view of the exemplary bimetallic thermostat of FIG. 2.

Turning now to FIGS. 5 through 10, various views are provided of bimetallic thermostat 120 (or portions thereof). In particular, FIG. 5 provides an exploded perspective view of bimetallic thermostat 120. FIGS. 6, 7, and 10 provide sectional views of bimetallic thermostat 120 (e.g., from different angles). For clarity, it is noted that a pair of connection terminals 131, 133 are illustrated as being flattened to extend radially in FIGS. 6 and 7, while being bent downward in the remaining figures and certain embodiments of the present disclosure. FIGS. 8 and 9 provide views of a conductive spring 160 of bimetallic thermostat 120, as will be described in greater detail below.

As shown, bimetallic thermostat 120 includes a discrete base 124 and top cap 126 that is held on base 124. Base 124 extends axially (e.g., parallel to the vertical direction V) between a first (e.g., upper) end 162 and a second (e.g., lower) end 164. For instance, at least a portion of top cap 126 may extend above base 124 (e.g., at the first end 162) and define an uppermost surface (e.g., at upper surface 150) of bimetallic thermostat 120 at distal end 122. Top cap 126 may be seated on top of or over base 124. In some embodiments, base 124 and top cap 126 are formed of, or include, distinct materials. For instance, base 124 may be formed from a substrate material, such as a thermally insulating or heat-resistant material (e.g., ceramic), while top cap 126 is formed from a second material, such as a relatively high thermal conductivity metal (e.g., including silver, copper, or aluminum, including alloys thereof). Top cap 126 may thus absorb and conduct heat faster or more readily than base 124. Optionally, support flange 128 may be integral with top cap 126 and extend directly therefrom (e.g., radially from cap wall 152).

In some embodiments, top cap 126 is press fitted on top of base 124. Optionally, top cap 126 may cover multiple segments of base 124, such as an upper frame 147 and a lower frame 149. In some embodiments, top cap 126 includes an upper surface 150 that extends across base 124 and a cap wall 152 that extends downwardly from upper surface 150 around base 124. Optionally, base 124 may define a central opening 144 (e.g., within which a bimetallic disk 154 is disposed). Thus, the upper surface 150 of top cap 126 may extend across and close central opening 144 while cap wall 152 contacts base 124, holding upper surface 150 in place.

Within base 124, bimetallic disk 154 may be mounted or otherwise positioned proximal to the first end 162 or top cap 126. As shown, a conductive spring 160 may be disposed further disposed within base 124 and in biased engagement with bimetallic disk 154. For instance, conductive spring 160 may be mounted below bimetallic disk 154 (e.g., proximal to second end 164). Conductive spring 160 may generally positioned between the second end 164 and bimetallic disk 154. Optionally, conductive spring 160 is held within lower frame 149. Additionally or alternatively, conductive spring 160 may be positioned below upper frame 147 while bimetallic disk 154 is positioned above at least a portion of upper frame 147 (e.g., such that upper frame 147 insulates conductive spring 160 from bimetallic disk 154 or central opening 144). Further additionally or alternatively, a support rod 166 may extend (e.g., axially) between conductive spring 160 (e.g., at a top lever) and bimetallic disk 154. For instance, support rod 166 may extend through an axial channel in base 124 (e.g., defined through upper frame 147) such that movement or biasing forces are transferred from conductive spring 160 to bimetallic disk 154 (and vice versa).

When assembled, conductive spring 160 may be in biased engagement with bimetallic disk 154 to motivate the bimetallic disk 154 towards the first end 162 within the base 124. In the illustrated embodiments, conductive spring 160 is formed as a cantilever spring having a pair of support levers connected by an integral fulcrum joint. In some embodiments, conductive spring 160 includes at least two discrete layers 168, 170. Specifically, a first layer 168 generally extends (e.g., according to the cantilever spring shape) from a contact end 172 to a joinder end 174. A second layer 170 extends (e.g., according to the cantilever spring shape) from a biasing end 176 to a secured end 178.

When assembled, the contact end 172 of first layer 168 is disposed proximal to bimetallic disk 154 while joinder end 174 is positioned therebelow (e.g., distal to bimetallic disk 154). For instance, joinder end 174 may be attached to base 124 at second end 164. Additionally or alternatively, joinder end 174 may be connected (e.g., electrically or mechanically connected) to a first terminal 131 (e.g., via a conductive pin 180).

With respect to the second layer 170, the biasing end 176 may be disposed proximal to bimetallic disk 154 while secured end 178 is positioned therebelow (e.g., distal to bimetallic disk 154). For instance, secured end 178 may be attached (e.g., mechanically attached) to base 124 at second end 164 (e.g., via conductive pin 180).

In certain embodiments, one of the spring layers 168 or 170 is nested within the other 170 or 168. For instance, second layer 170 may be nested within first layer 168. Specifically, the second layer 170 may be axially restrained between portions (e.g., the bottom lever portion and the top lever portion) of the first layer 168. In some such embodiments, the bottom lever portion of the second layer 170 may extend along a top surface of the bottom lever portion of the first layer 168 while the top lever portion of the second layer 170 extends along a bottom surface of the top lever portion of the first layer 168. When assembled, support rod 166 may rest on and extend from an upper surface of first layer 168 (e.g., to move therewith against bimetallic disk 154).

As illustrated in FIGS. 8 and 9, the spring layers 168 and 170 may be provided as discrete separable members that can be selectively slid together (e.g., during assembly). Alternative embodiments, however, may provide multiple spring layers as fixedly-joined, cladded members. In particular, the multiple spring layers may be bonded together by pressure cladding (e.g., without welding or adhesives), as would be understood.

Figure 11:
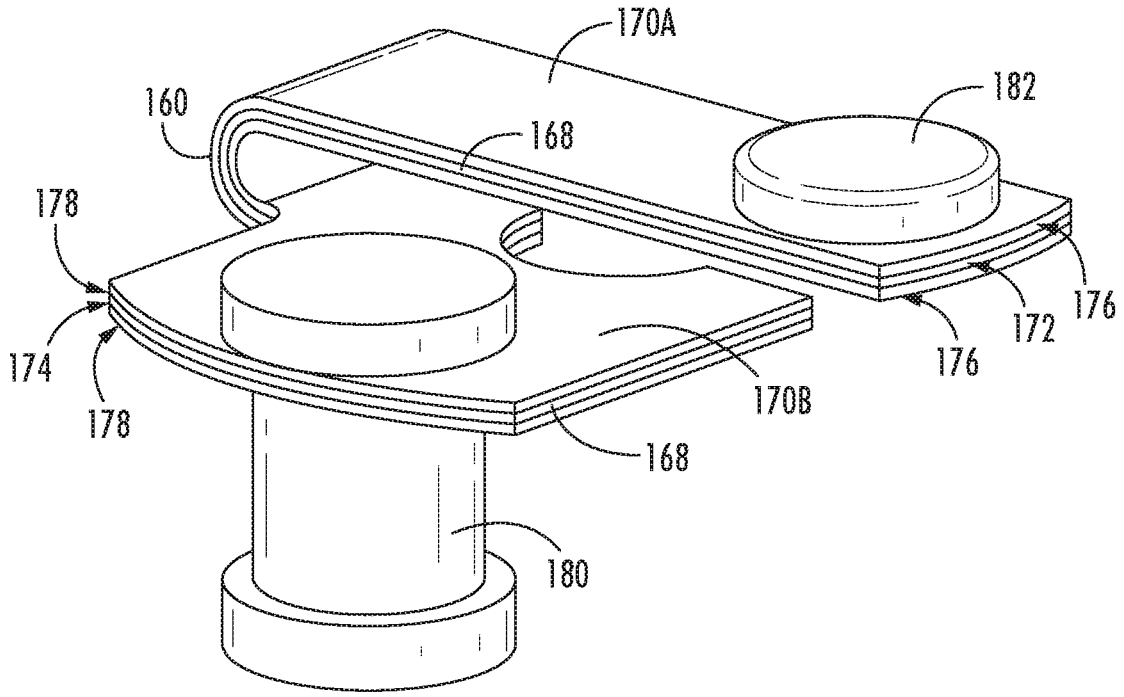
FIG. 11 provides a perspective view of a conductive spring of a thermostat according to further exemplary embodiments of the present disclosure.

As an example, and as shown in FIG. 11, the multiple spring layers may include a first layer 168 cladded to an exterior second layer 170A and an interior second layer 170B. Thus, the first layer 168 may be vertically-sandwiched between the exterior second layer 170A and interior second layer 170B. When assembled, support rod 166 (FIG. 6) may rest on and extend from an upper surface of exterior second layer 170B (e.g., to move therewith against bimetallic disk 154—FIG. 6).

Figure 12:
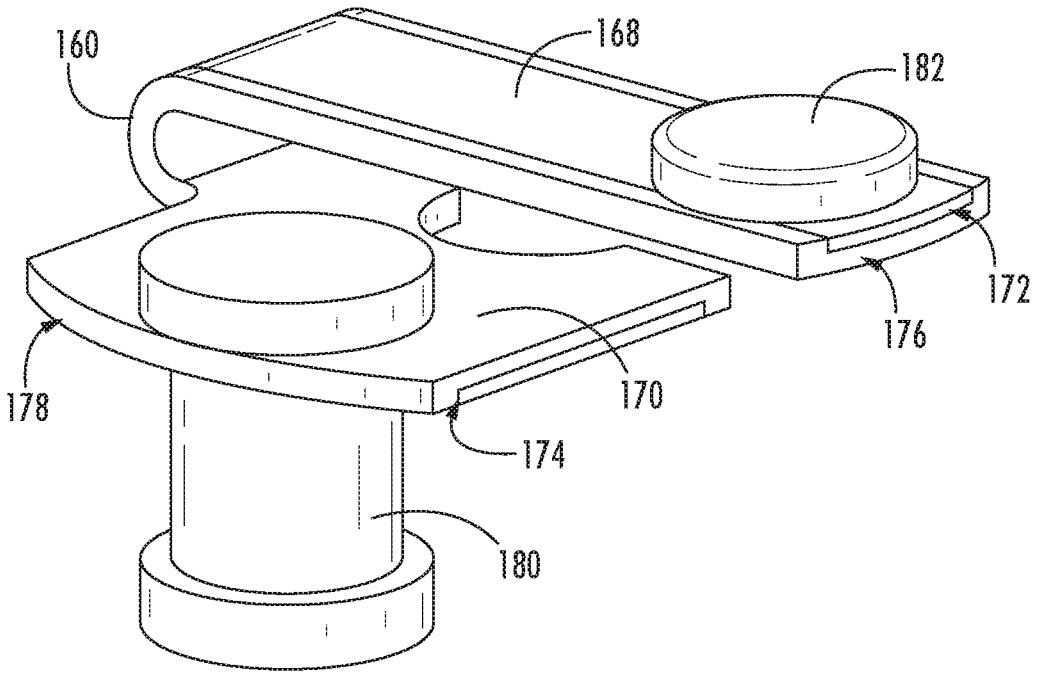
FIG. 12 provides a perspective view of a conductive spring of a thermostat according to exemplary embodiments of the present disclosure.

As another example, and as shown in FIG. 12, the multiple spring layers may include one or more inlaid layers, such as a inlaid first layer 168 cladded to base second layer 170. Thus, the inlaid first layer 168 may be supported within the base second layer 170. When assembled, support rod 166 may rest on and extend from an upper surface of first layer 168 (e.g., to move therewith against bimetallic disk 154).

Although two cladded examples are shown in FIGS. 11 and 12, further examples of cladded spring layer arrangements (e.g., side-by-side, overlaid, multiple inlays, etc.) would be possible within the scope of the present disclosure, as would be understood in light of the present disclosure.

Returning generally to FIGS. 5 through 12, in additional or alternative embodiments, secured end 178 is positioned over the joinder end 174 while the contact end 172 is positioned over the biasing end 176. Optionally, the conductive pin 180 may extend through the secured end 178 and the joinder end 174 (e.g., in conductive communication) to anchor both the secured end 178 and the joinder end 174 to base 124. Thus, secured end 178 may be attached to joinder end 174.

In some embodiments, a conduction pad 182 is included with the first layer 168. For instance, the upper surface of first layer 168 at contact end 172 may form an enlarged conduction pad 182 to selectively contact a conduction prong 184 extending in series from second terminal 133 mounted to base 124. In alternative embodiments, such as those of FIG. 11, conduction pad 182 may be mounted (e.g., conductively mounted, such as by a rivet) to first layer 168, such as through exterior second layer 170B.

In certain embodiments, conduction pad 182 is disposed or generally positioned below a contact surface of conduction prong 184 within base 124. During use, the conduction pad 182 may move with respect to the internal conduction prong 184 (e.g., as motivated by bimetallic disk 154) to selectively contact the same. Thus, conduction pad 182 may be in selective electrical connection with the second terminal 133 (e.g., according to the temperature at bimetallic disk 154).

Generally, the first layer 168 may have conduction or resistance characteristics that are different from the second layer 170. For instance, first layer 168 and second layer 170 may be formed of, or include, distinct materials (e.g., a first material and a second material, respectively). The second material may have a higher electrical resistivity than the first material such that electricity through conductive spring 160 is generally directed though the first layer 168. In some embodiments, the first material is a relatively high thermal conductivity metal (e.g., including silver, copper, or aluminum, including alloys thereof) while second material is a relatively low thermal conductivity metal (e.g., including nickel, iron, chromium, including alloys thereof, such as stainless steel). Advantageously, the second layer 170 may resist annealing from heat to support (e.g., in biased or axially motivated engagement) the first layer 168, which may be otherwise susceptible to such issues or heat.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An electric resistance heating coil assembly, comprising:

a spiral wound sheathed heating element having a first coil section and a second coil section; and a thermostat connected in series between the first and second coil sections of the spiral wound sheathed heating element, the thermostat comprising a base extending axially between a first end and a second end, a first terminal mounted to the base and connected to the first coil section, a bimetallic disk disposed within the base, and a conductive spring disposed within the base in biased engagement with the bimetallic disk to motivate the bimetallic disk towards the first end within the base, the conductive spring comprising a first layer and a second layer, the first layer extending from a contact end proximal to the bimetallic disk to a joinder end connected to the first terminal, and the second layer extending from a biasing end proximal to the bimetallic disk to a secured end fixed within the base, wherein the first layer comprises a top lever portion and a bottom lever portion, wherein the second layer comprises a top lever portion and a bottom lever portion, wherein the top lever portion of the second layer extends along a bottom surface of the top lever portion of the first layer, and wherein the bottom lever portion of the second layer extends along a top surface of the bottom lever portion.

2. The electric resistance heating coil assembly of claim 1, wherein the secured end is attached to the joinder end.

3. The electric resistance heating coil assembly of claim 1, wherein the secured end is positioned over the joinder end, and wherein the contact end is positioned over the biasing end.

4. The electric resistance heating coil assembly of claim 1, wherein the second layer is cladded to the first layer.

5. The electric resistance heating coil assembly of claim 1, further comprising a support rod extending axially from the bimetallic disk to the first layer.

6. The electric resistance heating coil assembly of claim 1, further comprising a second terminal mounted to the base and connected to the second coil section, wherein the first layer comprises a conduction pad in selective electrical connection with the second terminal at the contact end.

7. The electric resistance heating coil assembly of claim 1, wherein the first layer comprises a first material, and wherein the second layer comprises a second material having a higher electrical resistivity than the first material.

8. The electric resistance heating coil assembly of claim 7, wherein the first material comprises silver, copper, or aluminum.

9. The electric resistance heating coil assembly of claim 7, wherein the second material comprises nickel, iron, or chromium.

10. A cooktop appliance, comprising:

a heating element defining a heating zone; and a thermostat positioned within the heating zone of the heating element, the thermostat comprising a base extending axially between a first end and a second end, a first terminal mounted to the base, a bimetallic disk disposed within the base, and a conductive spring disposed within the base in biased engagement with the bimetallic disk to motivate the bimetallic disk towards the first end within the base, the conductive spring comprising a first layer and a second layer, the first layer extending from a contact end proximal to the bimetallic disk to a joinder end connected to the first terminal, and the second layer extending from a biasing end proximal to the bimetallic disk to a secured end fixed within the base, wherein the first layer comprises a top lever portion and a bottom lever portion, wherein the second layer comprises a top lever portion and a bottom lever portion, wherein the top lever portion of the second layer extends along a bottom surface of the top lever portion of the first layer, and wherein the bottom lever portion of the second layer extends along a top surface of the bottom lever portion.

11. The cooktop appliance of claim 10, wherein the secured end is attached to the joinder end.

12. The cooktop appliance of claim 10, wherein the secured end is positioned over the joinder end, and wherein the contact end is positioned over the biasing end.

13. The cooktop appliance of claim 10, wherein the second layer is cladded to the first layer.

14. The cooktop appliance of claim 10, further comprising a support rod extending axially from the bimetallic disk to the first layer.

15. The cooktop appliance of claim 10, further comprising a second terminal mounted to the base, wherein the first layer comprises a conduction pad in selective electrical connection with the second terminal at the contact end.

16. The cooktop appliance of claim 10, wherein the first layer comprises a first material, and wherein the second layer comprises a second material having a higher electrical resistivity than the first material.

17. The cooktop appliance of claim 16, wherein the first material comprises silver, copper, or aluminum.

18. The cooktop appliance of claim 16, wherein the second material comprises nickel, iron, or chromium.

19. An electric resistance heating coil assembly, comprising:

a spiral wound sheathed heating element having a first coil section and a second coil section; and a thermostat connected in series between the first and second coil sections of the spiral wound sheathed heating element, the thermostat comprising a base extending axially between a first end and a second end, a first terminal mounted to the base and connected to the first coil section, a bimetallic disk disposed within the base, a conductive spring disposed within the base in biased engagement with the bimetallic disk to motivate the bimetallic disk towards the first end within the base, the conductive spring comprising a first layer and a second layer, the first layer extending from a contact end proximal to the bimetallic disk to a joinder end connected to the first terminal, and the second layer extending from a biasing end proximal to the bimetallic disk to a secured end fixed within the base, and a support rod extending axially from the bimetallic disk to the first layer, wherein the first layer comprises a top lever portion and a bottom lever portion, wherein the second layer comprises a top lever portion and a bottom lever portion, wherein the top lever portion of the second layer extends along a bottom surface of the top lever portion of the first layer, and wherein the bottom lever portion of the second layer extends along a top surface of the bottom lever portion, wherein the secured end is attached to the joinder end, wherein the first layer comprises a first material, and wherein the second layer comprises a second material having a higher electrical resistivity than the first material.

20. The cooktop appliance of claim 19, wherein the first material comprises silver, copper, or aluminum, and wherein the second material comprises nickel, iron, or chromium.

* * * * *